US009233286B2

(12) United States Patent
Batista

(10) Patent No.: US 9,233,286 B2
(45) **Date of Patent: *Jan. 12, 2016**

(54) GOLF GLOVE

(71) Applicant: Callaway Golf Company, Carlsbad, CA (US)

(72) Inventor: Catherine Batista, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/623,240

(22) Filed: Feb. 16, 2015

(65) Prior Publication Data

US 2015/0157907 A1 Jun. 11, 2015

Related U.S. Application Data

(60) Division of application No. 13/585,016, filed on Aug. 14, 2012, now Pat. No. 8,955,167, and a continuation of application No. 29/406,499, filed on Nov. 15, 2011, now abandoned, and a continuation of application No. 29/427,535, filed on Jul. 19, 2012, now Pat. No. Des. 706,993.

(51) Int. Cl.

| | |
|---|---|
| ***A63B 57/00*** | (2015.01) |
| ***A63B 71/14*** | (2006.01) |
| ***A41D 19/015*** | (2006.01) |

(52) U.S. Cl.

CPC ..... *A63B 57/00* (2013.01); *A41D 19/01547* (2013.01); *A41D 19/01558* (2013.01); *A63B 71/141* (2013.01); *A63B 71/146* (2013.01)

(58) Field of Classification Search

CPC ..... A41D 19/01558; A63B 71/141; A63B 71/146

USPC ..... 2/159, 160, 161–161.4, 163, 164, 166, 2/168

See application file for complete search history.

(56) References Cited

U.S. PATENT DOCUMENTS

| | | | | | |
|---|---|---|---|---|---|
| 492,547 | A * | 2/1893 | Wurts | H01H 37/002 | 218/1 |
| 4,864,659 | A * | 9/1989 | Morris | A63B 71/148 | 2/161.1 |
| 5,195,188 | A * | 3/1993 | Bourdeau | A63B 71/146 | 2/159 |
| 5,251,335 | A * | 10/1993 | DeFusco | A63B 71/146 | 2/161.2 |
| 5,390,372 | A * | 2/1995 | Hashimoto | A63B 71/146 | 2/161.2 |
| 6,154,885 | A * | 12/2000 | Kobayashi | A63B 71/146 | 2/161.2 |
| 6,405,380 | B1 * | 6/2002 | Kuroda | A41D 19/01582 | 2/161.1 |
| 6,408,442 | B1 * | 6/2002 | Kang | A41D 19/01547 | 2/161.1 |
| 6,539,551 | B1 * | 4/2003 | Jones, Jr. | A63B 71/146 | 2/159 |
| 6,704,939 | B2 * | 3/2004 | Faulconer | A41D 19/01564 | 2/161.1 |
| 6,732,377 | B1 * | 5/2004 | Wilkinson | A41D 19/01552 | 2/161.4 |
| 6,862,744 | B2 * | 3/2005 | Kuroda | A41D 19/01582 | 2/161.1 |
| 2013/0117904 | A1 * | 5/2013 | Batista | A41D 19/01558 | 2/161.3 |

* cited by examiner

*Primary Examiner* — Gloria Hale

(74) *Attorney, Agent, or Firm* — Rebecca Hanovice; Sonia Lari; Michael Catania

(57) ABSTRACT

A golf glove having improved fit and gripping features is disclosed herein. The golf glove of the present invention includes gripping features permanently disposed on one or more of the fingers, preferably the front surfaces of the ring and little fingers, and also includes an expandable slit that extends from an opening and that helps the golf glove expand to receive a golfer's hand and then retract so that the glove fits comfortably on the golfer's hand.

10 Claims, 2 Drawing Sheets

GOLF GLOVE

CROSS REFERENCES TO RELATED APPLICATIONS

The present application is a divisional of U.S. patent application Ser. No. 13/585,016, filed on Aug. 14, 2012, and issued on Feb. 17, 2015, as U.S. Pat. No. 8,955,167, which is continuation-in-part of U.S. Design Patent Application No. 29/406,499, filed on Nov. 15, 2011, and a continuation-in-part of U.S. Design Patent Application No. 29/427,535, filed on Jul. 19, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates generally to golf gloves, and more particularly to a tab-less golf glove with gripping features disposed on at least a portion of the fingers.

2. Description of the Related Art

When swinging a golf club, golfers often wear a golf glove on at least one hand to protect the hand, provide a better grip on the golf club, and increase their comfort during the swing. Rule 14-3 and Appendix IV, Section 2 of the USGA Rules and Decisions regulate the features that may be included in golf gloves to be used during regulation play, and can be accessed at the USGA website www.usga.gov. Golf gloves are typically made from leather or synthetic materials, and traditionally include a back portion, a palm-side portion, finger and thumb portions, an opening at the wrist to receive the golfer's hand, a slit extending upwards from the opening, and a tab at the opening and next to the slit that is configured to allow the golfer to adjust the glove to his or her hand.

Traditional golf gloves have certain drawbacks, however. The palm side portion of the gloves can become slippery if used during inclement weather, thus making it difficult for the golfer to adequately grasp the club. Furthermore, while the tab portion of the glove may be useful for adjustment purposes, it adds weight and bulk to the glove and can be uncomfortable. As such, there is a need for a lightweight golf glove having improved comfort, gripping, and adjustment features.

BRIEF SUMMARY OF THE INVENTION

The golf glove of the present invention is directed to a tab-less golf glove with high-friction material on the palm side of the finger portions.

One aspect of the present invention is a golf glove is a golf glove comprising a front section comprising an inner surface and an outer surface, and back section comprising an inner surface and an outer surface, wherein the front section connects with the back section to form a hand body section, a thumb section, an index finger section, a middle finger section, a ring finger section, a little finger section, and an opening, wherein the back section comprises a slit that connects with the opening, and wherein the front section comprises a plurality of raised gripping features disposed on at least the ring finger section and the little finger section. In one embodiment, the plurality of raised gripping features may be disposed on an upper portion of the ring finger section and an upper portion of the little finger section. In another embodiment, the plurality of raised gripping features may not be disposed on the entire front section of the ring finger section and the little finger section. In some embodiments, the plurality of raised gripping features may be composed of a silicon material.

In some embodiments, the slit may extend from the opening toward the thumb section. Some embodiments may further comprise an expansion portion, which may extend across and covers the slit. In some of these embodiments, the expansion portion may be composed of an elastic material. In one embodiment, the expansion portion may be affixed to the inner surface of the back section. In some embodiments, the golf glove may further comprise a pull tab, which may be disposed on the outer surface of the front section. The pull tab may be disposed proximate the opening. In other embodiments, the golf glove may further comprise a sweat band, which may be disposed proximate the opening. In a further embodiment, the sweat band may be affixed to the inner surface of the front section and the back section.

Another aspect of the present invention is a golf glove comprising a back section comprising a first material, a second material, and a third material, and a front section comprising a fourth material and a fifth material, wherein the front section connects with the back section to form a hand body section, a thumb section, an index finger section, a middle finger section, a ring finger section, a little finger section, and an opening, wherein a majority of the back section of the hand body section and the back sections of the index finger section, the middle finger section, and the ring finger section are composed of the first material, wherein the back section of the little finger section is composed of the second material, wherein the third material is disposed between the first material and the second material, wherein the front section of the hand body section and the front sections of the thumb section, the index finger section, and the middle finger section are composed of the fourth material, wherein the front sections of the ring finger section and the little finger section are composed of the fifth material, and wherein a plurality of raised gripping features are disposed on an external surface of the fifth material.

In some embodiments, each of the first material, second material, and third material may be an elastic material and each of the fourth material and the fifth material may be a leather material. The plurality of gripping features may be composed of a silicon material. Some embodiments of the golf glove may further comprise a slit and an expansion portion, wherein the slit may be disposed in the back section and extend from the opening towards the thumb section, wherein the expansion portion may cover the slit, and wherein the expansion portion may be composed of an elastic material. In some embodiments, this golf glove may further comprise a pull tab.

Yet another aspect of the present invention is a golf glove comprising a back section comprising a first elastic material, a second elastic material, and a third elastic material, a front section comprising a leather material and a suede material, and a pull tab, wherein the front section connects with the back section to form a hand body section, a thumb section, an index finger section, a middle finger section, a ring finger section, a little finger section, and an opening, wherein the back sections of the hand body section, the index finger section, the middle finger section, and the ring finger section are composed of the first elastic material, wherein the back section of the little finger section is composed of the second elastic material, wherein the third elastic material is disposed between the first material and the second material, wherein the front sections of the hand body section, the thumb section, the index finger section, and the middle finger section are composed of the leather material, wherein the front sections of the ring finger section and the little finger section are composed of the suede material, wherein a plurality of raised gripping features composed of a silicon material are disposed on an external surface of the suede material, wherein the first elastic material has a greater elasticity than the third elastic material and a lower elasticity than the second elastic material, and wherein the pull tab is disposed on the leather material proximate the opening. In some embodiments, the pull tab may be composed of a suede material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 2:
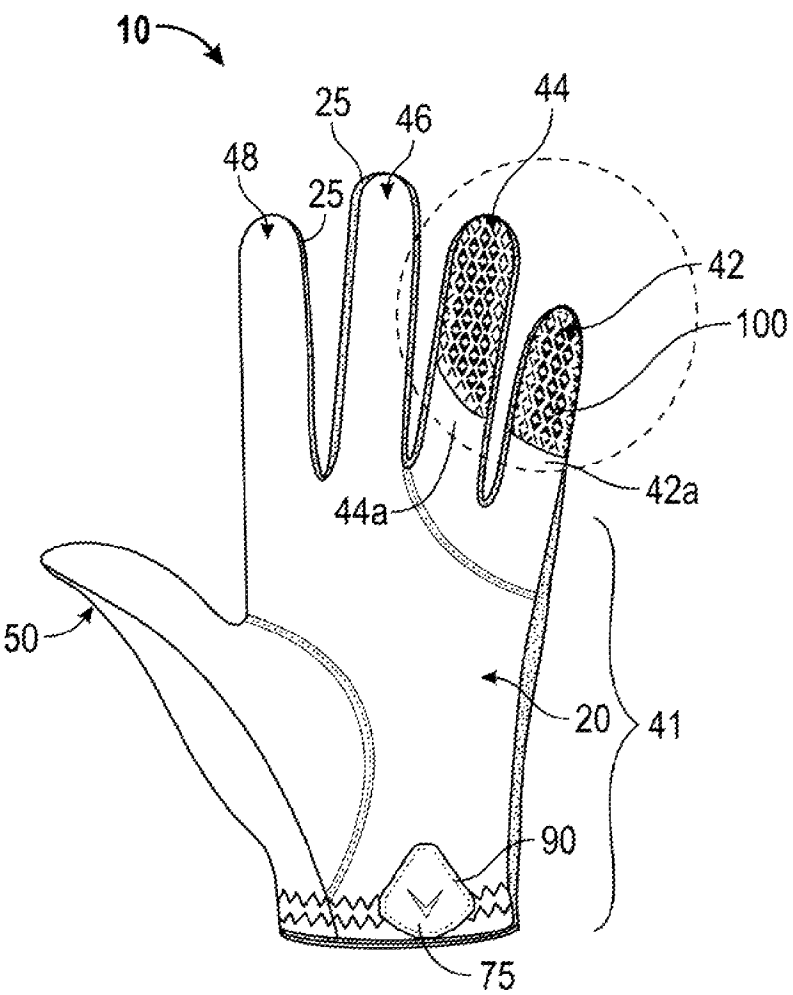
FIG. 2 is a front perspective view of the embodiment shown in FIG. 1.
Figure 1:
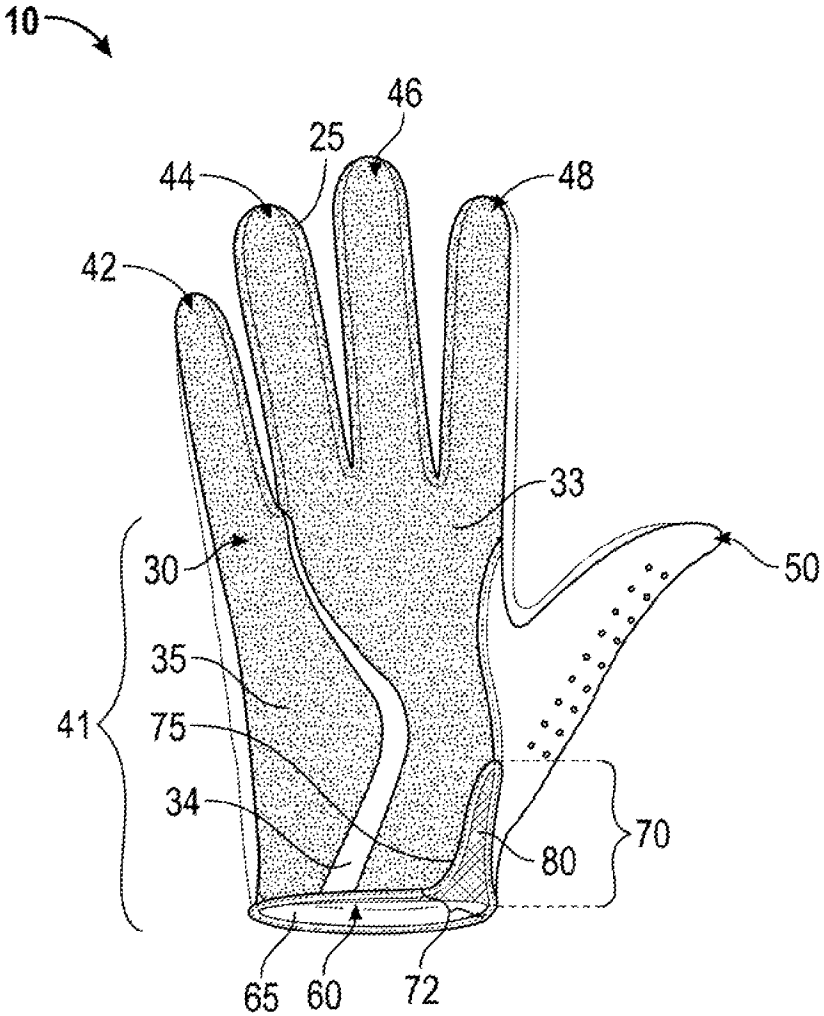
FIG. 1 is rear perspective view of a first embodiment of the present invention.

A preferred embodiment of the golf glove of the present invention is shown in FIGS. 1-2. As shown in these Figures, the golf glove 10 comprises a front or palm-side section 20 and a back or dorsal section 30, which combine to form a hand body section 41, and which include extensions that combine to form a little finger section 42, a ring finger section 44, a middle finger section 46, an index finger section 48, and a thumb section 50. The golf glove 10 further includes one or more fourchettes 25 disposed between the front and back sections 20, 30 on each of the finger sections 42, 44, 46, 48 and the thumb section 50.

Though the golf glove 10 may be made from any material known to a person of ordinary skill in the art, the material of at least one of the front section 20, back section 30, and fourchettes 25 preferably has elastic properties that allow the golf glove 10 to fit securely around the hand of a golfer without uncomfortably constricting the hand. The material used to make the back section 30 preferably is a mesh or two-way knit fabric to provide breathability and elasticity, while the material of the front section 20 and the fourchettes 25 preferably is real or synthetic leather to provide friction between the gloved hand and the golf club head during play.

In the preferred embodiment, and as shown in FIG. 1, the back section 30 is formed from a plurality of materials that are stitched or otherwise connected to each other to cover most of the dorsal side of a golfer's hand. In this embodiment, the back section 30 of the hand body section 41, the ring finger section 44, the middle finger section 46, and the index finger section 48 is composed of a honeycomb mesh fabric 33, the back section 30 of the little finger section 42 is composed of a less elastic mesh fabric 35, and a more elastic mesh fabric 34 extending connects the honeycomb mesh fabric 33 and the less elastic mesh fabric 35 and extends from the opening to a point between the little finger section 42 and the ring finger section 44. The front and back sections 20, 30 of the thumb section 50 preferably are composed of a non-elastic material, and most preferably a leather or synthetic leather material.

The front section 20 of the golf glove 10 of the present invention preferably is also composed of one or more non-elastic materials. In the preferred embodiment, and as shown in FIG. 2, the front sections 20 of the hand body 41 (i.e., the palm covering), the thumb section 50, the index finger section 48, the middle finger section 46, and at least half of the ring and little finger sections 44, 42 are composed of a leather material. The front sections 20 of the upper portions 42*a*, 44*a* of the little and ring finger sections 42, 44 are preferably composed of a different, inelastic material, such as suede, to increase the friction created between these portions of the glove 10 and a golf club during use. The front sections 20 of these upper portions 42*a*, 44*a* further comprise raised gripping features 100, shown in FIGS. 2, 3A, and 3B, which increase the friction between the golf glove 10 and the golf club during use and provide added control for the golfer using the little and ring fingers.

Figure 3A:
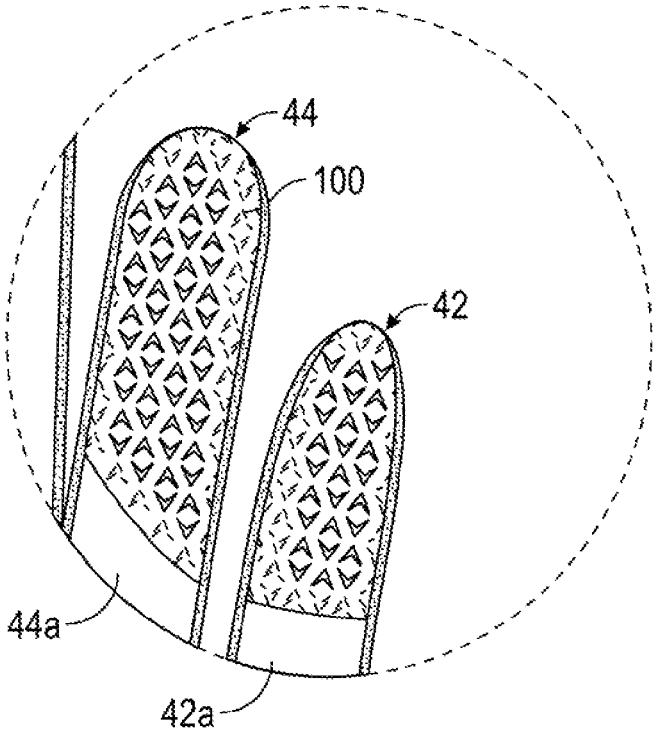
FIG. 3A is a front, plan view of the circled portion of the embodiment shown in FIG. 2.
Figure 3B:
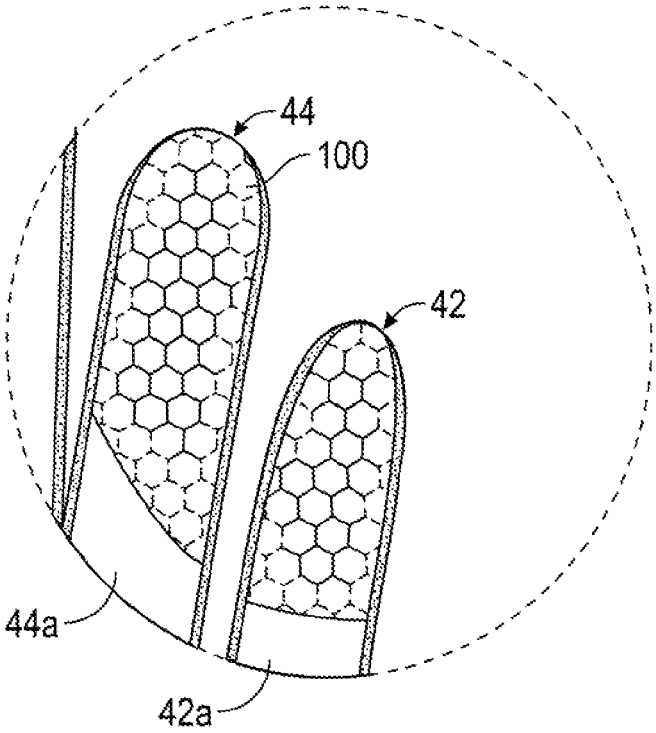
FIG. 3B is a front, plan view of a second embodiment of the circled portion of the embodiment shown in FIG. 2.

In the preferred embodiment, the raised gripping features 100 are composed of a silicon material, but may be made of any other high-friction material known to a person of ordinary skill in the art. The gripping features 100 preferably are printed onto the material of the front section 20, but in alternative embodiments may be affixed to the material in any way known in the art. As shown in FIGS. 3A and 3B, the gripping features 100 preferably are disposed on the front sections 20 of the upper portions 42*a*, 44*a* of the little and ring finger sections 42, 44 in any pattern desired by the manufacturer or the golfer, which can add to the overall aesthetic appeal of the glove to consumers. In other embodiments, the gripping features 100 may be disposed on part or all of the front sections 20 of different finger or thumb sections 46, 48, 50, or all finger and thumb sections 42, 44, 46, 48, 50 of the golf glove 10.

The golf glove 10 further comprises an opening 60 sized to receive a golfer's hand, and a slit 70 extending from the opening 60 into the back section 30 of the golf glove 10 that allows the opening 60 to expand sufficiently for a golfer to pull the golf glove 10 onto his or her hand. The slit 70 is preferably triangular in shape, but may be circular, elliptical, or any other shape desired by a golfer or manufacturer, as long as it effectively helps the opening 60 expand as needed. In alternative embodiments, this slit 70 may extend into the front section 20 of the glove or may be disposed at a point at which the front section 20 meets the back section 30. As shown in FIG. 1, the slit 70 preferably extends into the back section 30 proximate the thumb section 50. The slit 70 preferably includes piping 75 along its edges to maintain its overall shape, and this piping 75 preferably extends around the opening 60 of the golf glove 10 for aesthetic purposes and also to prevent the material of the golf glove 10 from fraying during use.

A sweat band 65 composed of absorbent material preferably is affixed to the interior surface of one or more of the front section 20 or the back section 30 of the glove 10 proximate the opening 60 to prevent sweat from accumulating within the glove 10 or dripping down the golfer's wrist or hand during play. The sweat band 65 preferably extends from one side of the slit 70, around the circumference of the opening 60, and terminates at the other side of the slit 70, but in alternative embodiments may extend only part of the way around the opening 60. The sweat band 65 also is preferably made of an elastic material that helps the opening expand and contract around a golfer's hand as the golfer pulls the golf glove 10 on.

An expansion portion 80 made of elastic material is disposed within the opening 72 created by the slit 70 to allow the slit to open to receive a golfer's hand and then return to its original configuration. While the expansion portion 80 may be constructed as described in U.S. Pat. No. 7,480,944 and enclosed or encased within a sleeve portion (not shown), it is preferably attached directly to an interior surface of the front or back sections 20, 30 as close to the edge of the slit 70 as possible to reduce the overall weight of the golf glove 10. The expansion portion 80 also preferably closes the entire opening 72 created by the slit 70 to prevent dirt and debris from entering the golf glove 10 during use. A pull tab 90 formed from highly graspable material such as silicon, ridged plastic, microfiber, or suede, is provided proximate the opening 60 on an exterior surface of the front or back sections 20, 30, and preferably on the front section 20 of the golf glove 10. This pull tab 90 provides a golfer with a surface to grip while pulling on the golf glove 10.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf glove comprising:

a front section comprising an inner surface and an outer surface;

a back section comprising an inner surface and an outer surface; and an expansion portion composed of an elastic material, wherein the front section connects with the back section to form a hand body section, a thumb section, an index finger section, a middle finger section, a ring finger section, a little finger section, and an opening, wherein the back section comprises first, second, and third materials, wherein the front section comprises fourth and fifth materials, wherein each of the first, second, third, fourth, and fifth materials is different from each of the other materials, wherein the back section comprises a slit that connects with the opening, wherein the slit extends from the opening toward the thumb section, wherein the expansion portion extends across and covers the slit, and wherein the front section comprises a plurality of raised gripping features disposed on at least the ring finger section and the little finger section.

2. The golf glove of claim 1, wherein the plurality of raised gripping features is disposed on an upper portion of the ring finger section and an upper portion of the little finger section.

3. The golf glove of claim 1, wherein the plurality of raised gripping features is composed of a silicon material.

4. The golf glove of claim 1, wherein the plurality of raised gripping features is not disposed on the entire front section of the ring finger section and the little finger section.

5. The golf glove of claim 1, wherein the expansion portion is affixed to the inner surface of the back section.

6. The golf glove of claim 1, further comprising a pull tab.

7. The golf glove of claim 6, wherein the pull tab is disposed on the outer surface of the front section.

8. The golf glove of claim 7, wherein the pull tab is disposed proximate the opening.

9. The golf glove of claim 1, further comprising a sweat band, wherein the sweat band is disposed proximate the opening.

10. The golf glove of claim 9, wherein the sweat band is affixed to the inner surface of the front section and the back section.

* * * * *